US006260951B1

(12) United States Patent
Harvey et al.

(10) Patent No.: US 6,260,951 B1
(45) Date of Patent: Jul. 17, 2001

(54) METHOD OF MANUFACTURING OF PRINTING APPARATUS

(75) Inventors: Robert A. Harvey, Cambridge; Ian Ingham, Essex, both of (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/507,330

(22) Filed: Feb. 18, 2000

Related U.S. Application Data

(63) Continuation of application No. PCT/GB98/02519, filed on Aug. 21, 1998.

(30) Foreign Application Priority Data

Aug. 22, 1997 (GB) ..... 9717698
Sep. 4, 1997 (GB) ..... 9718641

(51) Int. Cl.[7] ..... B41J 2/14
(52) U.S. Cl. ..... 347/49
(58) Field of Search ..... 347/85, 87, 32, 347/42, 49; 29/890.1

(56) References Cited

U.S. PATENT DOCUMENTS

| | | | |
|---|---|---|---|
| 4,559,543 | 12/1985 | Toganoh et al. | 347/32 |
| 4,736,213 | 4/1988 | Piatt et al. | 347/49 |
| 4,755,836 | 7/1988 | Ta et al. | 347/49 |
| 5,148,194 | 9/1992 | Asai et al. | 347/49 |
| 5,243,755 | 9/1993 | Inaba et al. | 29/890.1 |
| 5,257,043 | 10/1993 | Kneezel | 347/42 |
| 5,305,521 | 4/1994 | Inaba et al. | 29/890.1 |
| 5,317,339 | 5/1994 | Braun et al. | 347/87 |
| 5,392,063 | 2/1995 | Rhoads | 347/49 |
| 5,408,746 | 4/1995 | Thoman et al. | 29/890.1 |
| 5,617,128 | 4/1997 | Thoman et al. | 347/87 |
| 5,646,658 | 7/1997 | Thiel et al. | 347/49 |
| 5,646,665 | 7/1997 | Swanson et al. | 347/87 |
| 5,847,722 * | 12/1998 | Hackleman | 347/19 |

FOREIGN PATENT DOCUMENTS

| | | |
|---|---|---|
| 0 313 205 A2 | 4/1989 | (EP) . |
| 0 379 151 A2 | 7/1990 | (EP) . |
| 0 478 244 A2 | 4/1992 | (EP) . |
| 0 486 309 A2 | 5/1992 | (EP) . |
| 0 529 879 A1 | 3/1993 | (EP) . |
| 02188246 | 7/1990 | (JP) . |
| 04247942 | 9/1992 | (JP) . |

OTHER PUBLICATIONS

International Search Report dated Nov. 26, 1998, Int'l. Appl. No. PCT/GB98/02519.
International Preliminary Examination Report dated Jun. 14, 1999, Int'l. Appl. No. PCT/GB98/02519.

* cited by examiner

*Primary Examiner*—N. Le
*Assistant Examiner*—Anh T. N. Vo
(74) *Attorney, Agent, or Firm*—Marshall, O'Toole, Gerstein, Murray & Borun

(57) ABSTRACT

To allow accurate positioning relative to a printer mechanism, a printhead is provided with a reference surface formed on a reference member. The reference member is attached to the base of the printhead but positioned with reference to a nozzle of an ink ejecting unit mounted on the base member. This obviates the need for the base member to be manufactured to narrow tolerances.

24 Claims, 10 Drawing Sheets

METHOD OF MANUFACTURING OF PRINTING APPARATUS

This is a continuation of International Application No. PCT/GB98/02519 filed Aug. 21, 1998, the entire disclosure of which is incorporated herein by reference.

BACKGROUND OF THE INVENTION

The present invention relates to methods of manufacture of printing apparatus, particularly methods of manufacture of droplet deposition apparatus such as inkjet printheads.

Apparatus for deposition of droplets of ink or other fluid are well known. As shown, for example, in EP-A-0 278 590 (belonging to the present applicant and incorporated herein by reference), they comprise one or more ink ejecting chambers from which droplets of ink are ejected, generally via a nozzle, towards a substrate on which an image is to be printed.

To ensure correct positioning of the printed image on the substrate, it is necessary to position the ink ejecting chambers and/or their nozzles accurately relative to the substrate. This is particularly important where several printheads are used to print several overlapping images of different colours (normally cyan, magenta, yellow and black) to provide a full-colour printed image.

Typically, a printer mechanism is employed to hold the substrate relative to a reference surface on the printhead. The printhead is in turn manufactured such that the reference surface lies a fixed distance from the ink ejecting chambers and/or their nozzles of the printing unit (where a printhead has an array of ink ejecting chambers, the reference surface may be positioned relative to a particular one (e.g. the first) of the ink ejecting chambers). However, a tight tolerance on this fixed distance is necessary if the overall positioning of the printhead relative to the substrate is to be to the high accuracy required. Manufacturing the printhead to such tight tolerances may be difficult to achieve, however, and will depend, inter alia, on the material of the printhead, its form and overall dimensions. The present invention seeks to avoid these difficulties.

SUMMARY OF THE INVENTION

Accordingly, the invention consists a method of locating a reference surface on a printing apparatus, the apparatus comprising a printing unit having at least one printing element and mounted on a support member; the method comprising the steps of: positioning the apparatus such that said printing element is located at a first predetermined position; positioning a reference member having said reference surface such that said reference surface is located at a second predetermined position; said first and second positions being in a predetermined spatial relationship; and fixing the reference member to said support member, thereby to fix said reference surface in a predetermined position relative to said printing element.

By this method, it is possible to align the printing elements of a printing apparatus with the reference surface independently of any intermediate printhead structure, thereby avoiding any difficulties that may be associated with such an intermediate structure. and any manufacturing difficulties associated therewith.

Where the printing apparatus is droplet deposition apparatus such as an inkjet printhead, the term 'printing element' covers not only an ink ejecting chamber in a printhead but also the respective nozzle, where this is present.

The present invention also consists in a method of manufacturing a printing apparatus that includes a printing unit comprising a droplet ejection unit having at least one printing element, said at least one printing element comprising a nozzle for droplet ejection formed in a nozzle plate, and a support member for said droplet ejecting unit; the method comprising the steps of: mounting said droplet ejecting unit on said support member; thereafter forming at least one nozzle in said nozzle plate of the droplet ejecting unit; and thereafter arranging a reference member such that a reference surface of said reference member is located at a predetermined position relative to said at least one nozzle; and fixing the reference member to said support member.

As before, such a method allows the nozzles of a droplet deposition apparatus to be aligned with the reference surface independently of any intermediate printhead structure, thereby avoiding any difficulties that may be associated with such an intermediate structure. Furthermore, since the relative positioning of nozzle and reference surface only takes place after the droplet ejecting unit has been mounted on its support member, the mounting process need only be carried out to an accuracy appropriate to the relative location of the unit and the support member rather than to an accuracy appropriate to the relative location of a nozzle of unit and a reference surface of the support member.

BRIEF DESCRIPTION OF THE INVENTION

The above method may require the assembly of the droplet ejecting unit to be substantially complete before it is mounted on the support member, in which case the formation of the nozzles is advantageously achieved by means of a high energy beam such as a laser directed at the outside surface of the nozzle plate i.e. that surface of the nozzle plate from which droplet ejection takes place. Such a technique is disclosed in WO93/15911, belonging to the present applicant and incorporated herein by reference.

Further advantageous embodiments of the invention are set out in the dependent claims and description that follows.

The invention will now be described by way of example by reference to the following figures of which:

Figure 1:
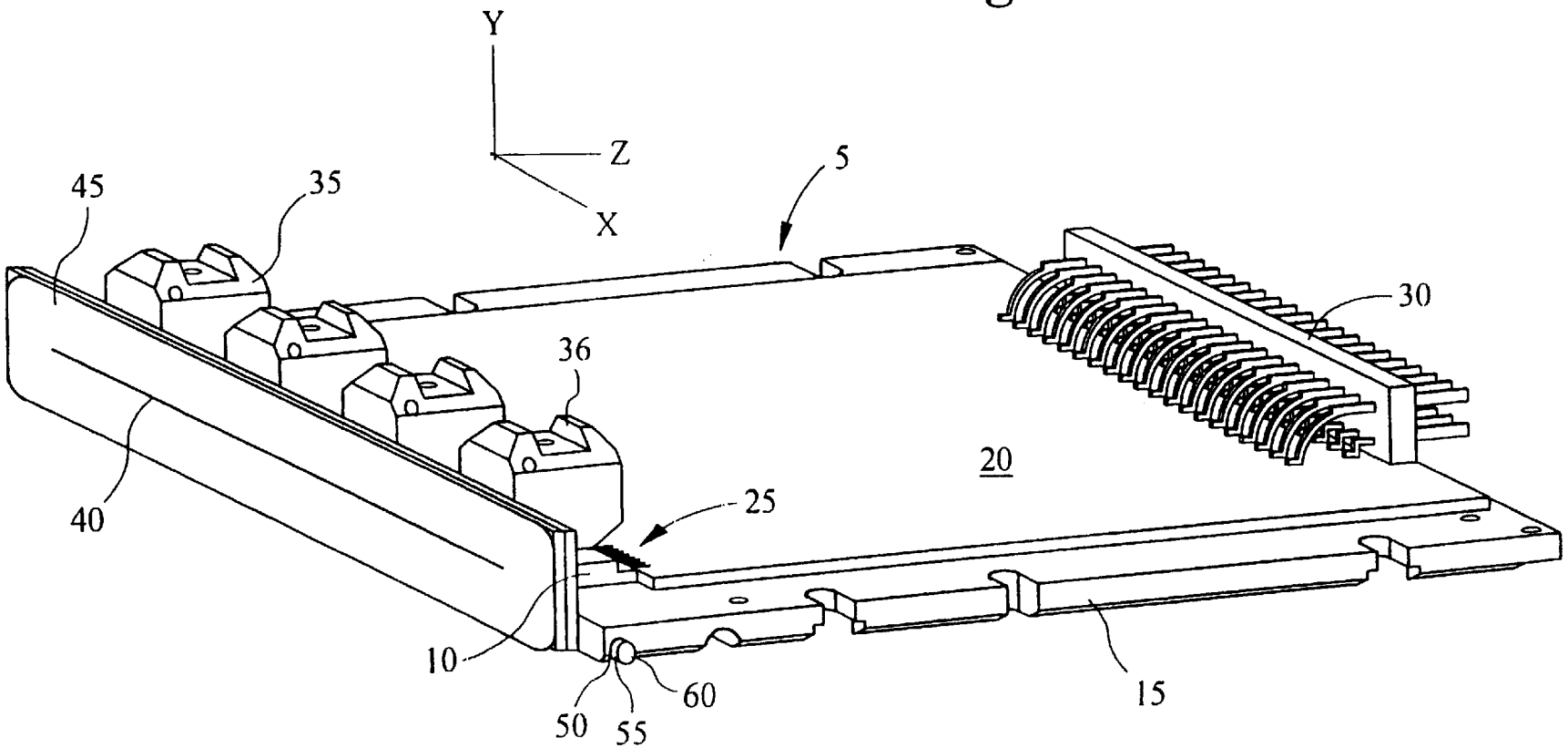
FIG. 1 is a perspective view of a printhead manufactured according to the present invention.
Figure 7:
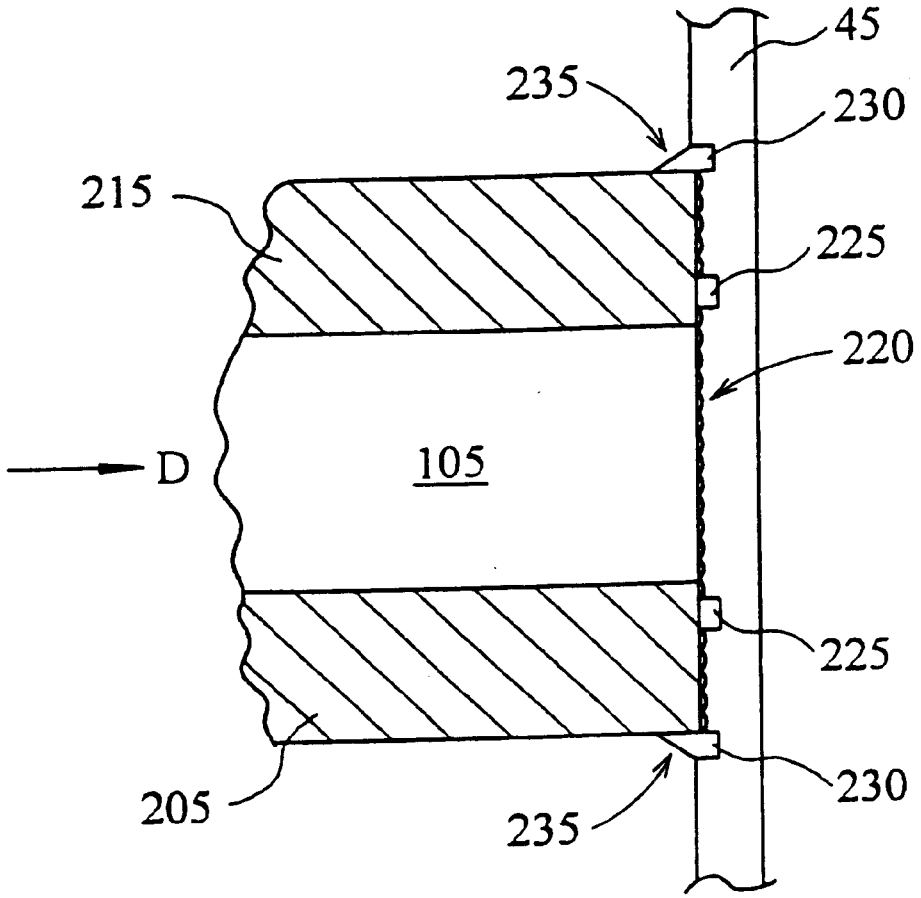
Figure 8:
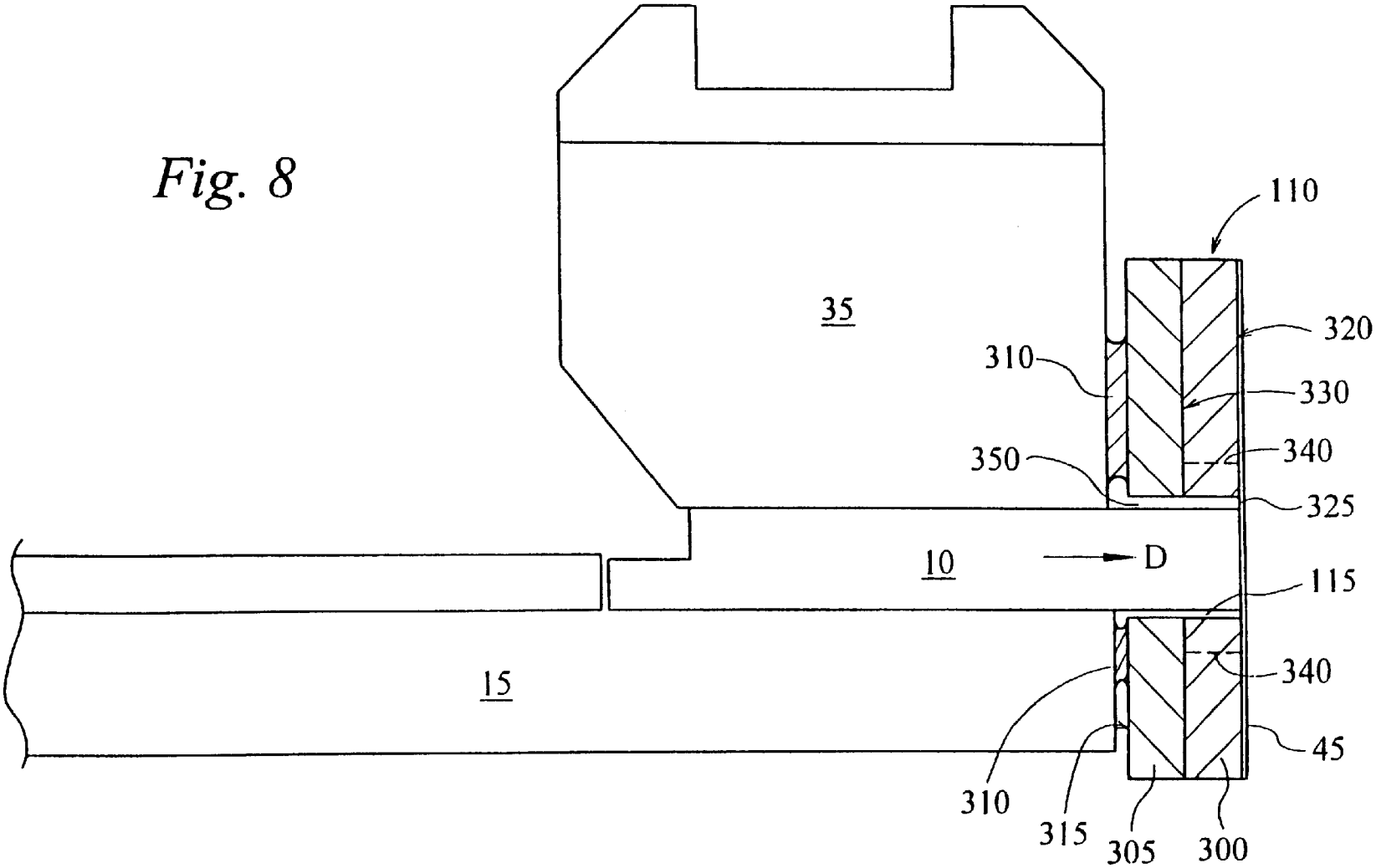
Figure 9:
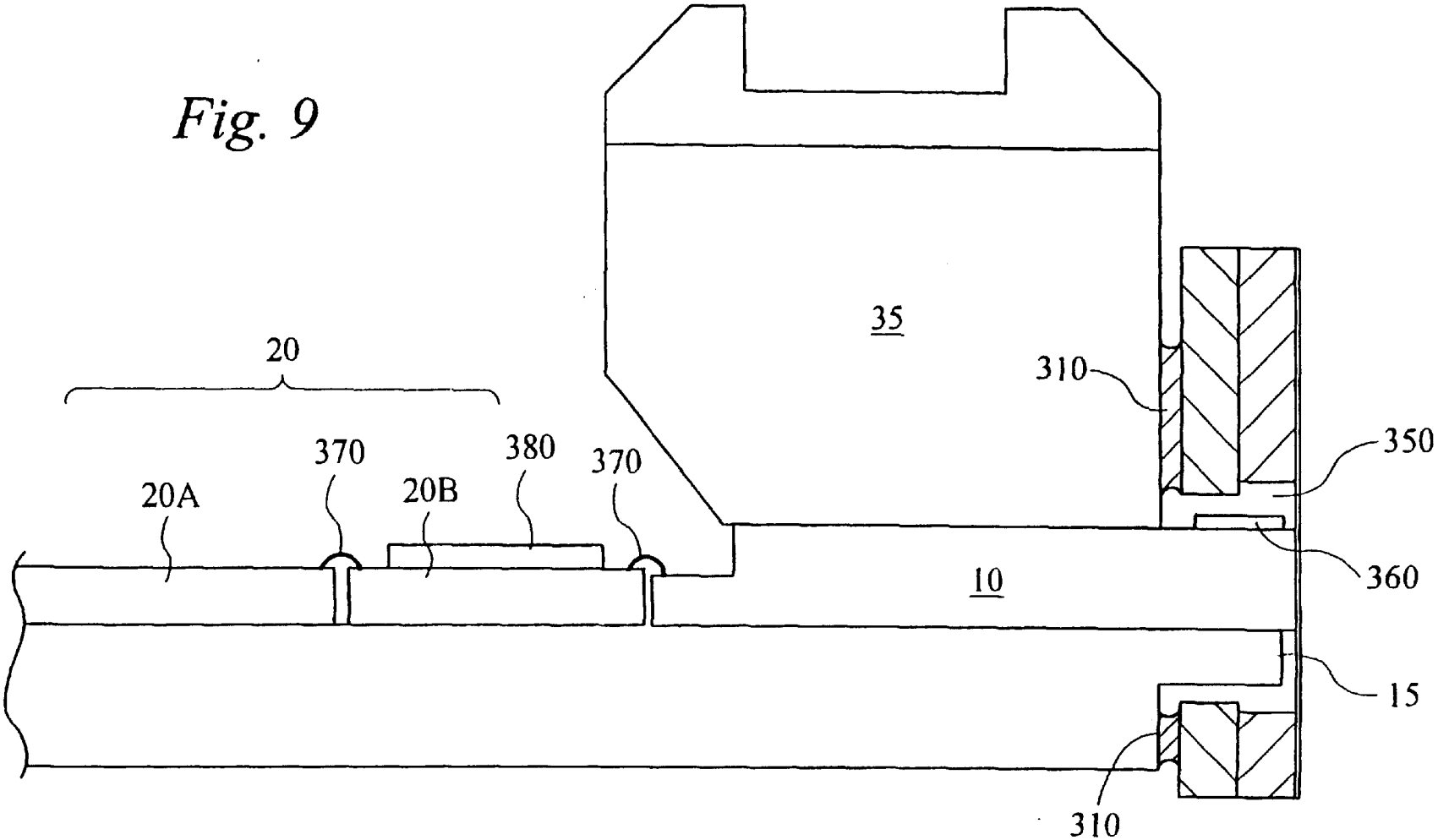
Figure 10:
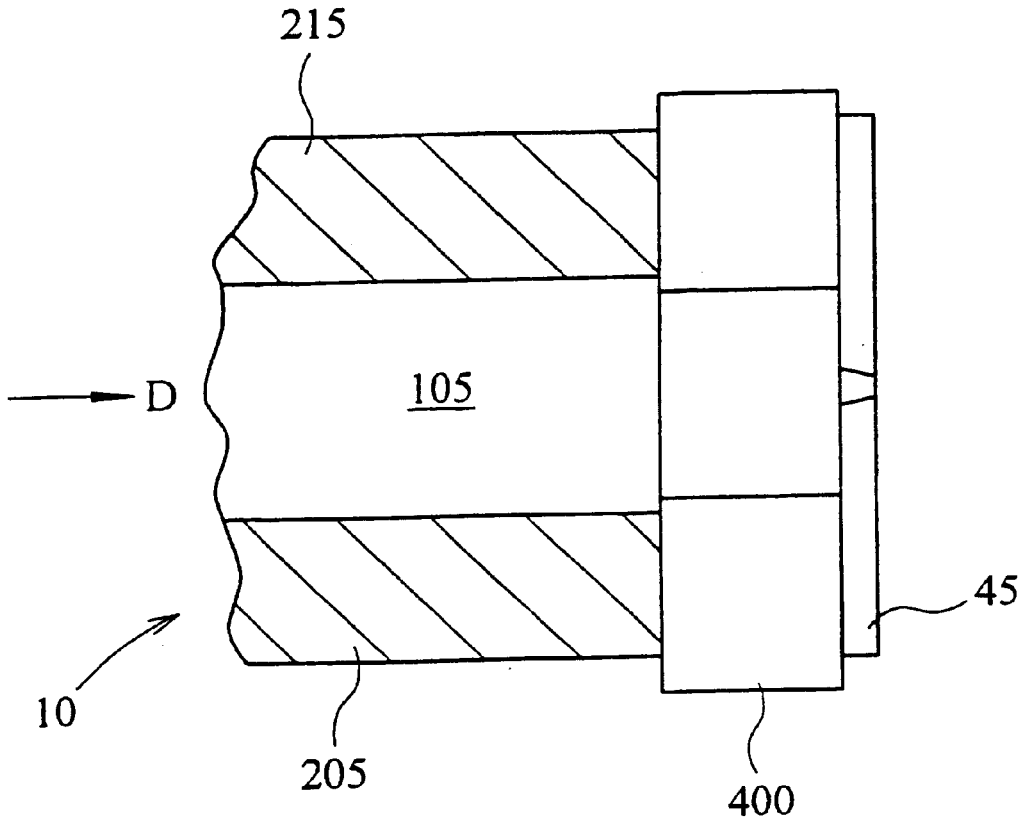

FIG. 7 a detailed sectional view of the front end of the ink ejecting units of FIG. 1 taken parallel to the ink channel axis D;

FIG. 8 is a sectional view of the front end of the printhead of FIG. 1 taken parallel to the ink channel axis D;

FIG. 9 is a sectional view of the front end of the printhead of FIG. 1 according to another embodiment;

FIG. 10 is a sectional view of the front end of an ink ejecting unit according to yet another embodiment.

DESCRIPTION OF PREFERRED EMBODIMENTS

FIG. 1 depicts an inkjet printhead 5 manufactured according to the present invention and comprising an ink ejection unit or units 10 mounted at one end of a base member 15. Base member 15 may be made of a thermally conductive material such as aluminium so as to carry away heat generated both in the ink ejection units and in printhead driving circuitry mounted on circuit board 20. Driving signals are conveyed from one end of the circuit board to the ink ejection units, for example by wire bonds 25, whilst print data and power arrive at the other end of the circuit board via connector 30.

As shown, four manifolds 35 supply ink of four different colours (generally cyan, magenta, yellow and black) to four neighbouring ink ejection units, although these manifolds could equally well supply the same colour ink to all ink ejection units or be replaced by a single ink manifold. As explained hereafter, registration between the channels of the different ink ejection units is achieved e.g. by forming all four units in a single base member. Manifolds 35 are clamped in sealing contact with the ink ejection units 10 by means of a bar (not shown) that sits in recesses 36 and which in turn is secured—e.g. by means of bolts—to chassis 15. These features are known in the art, e.g. from WO97/04963 belonging to the applicant and incorporated herein by reference, and consequently do not require discussion in any further detail. Ink ejection takes place from a line of nozzles 40 formed in a nozzle plate 45, with each nozzle communicating with a respective ink-ejecting chamber of the ink ejecting unit 10.

Base 15 is formed on its lower surface with a groove 50 in which a rod 55 is located so as to protrude from one side of the base as illustrated in FIG. 1. The end surface 60 of rod 55 serves as a reference surface/datum face, registering with another datum on a printhead support structure (not shown) so as to ensure the correct positioning in the nozzle array (X) direction of the printhead within that support structure. This in turn requires that the reference surface to lie perpendicular to the nozzle array direction and, where the reference member is prismatic having a prism axis, that this axis lies parallel to the nozzle array direction.

In particular, rod 55 allows the ink ejecting nozzles to be correctly located within the printhead support structure which in turn ensures the correct positioning in the X-direction of the ink droplets ejected from the nozzles on the substrate to be printed (obviously, any variation from printhead to printhead in the positioning of the printed image on the substrate is undesirable).

Figure 2:
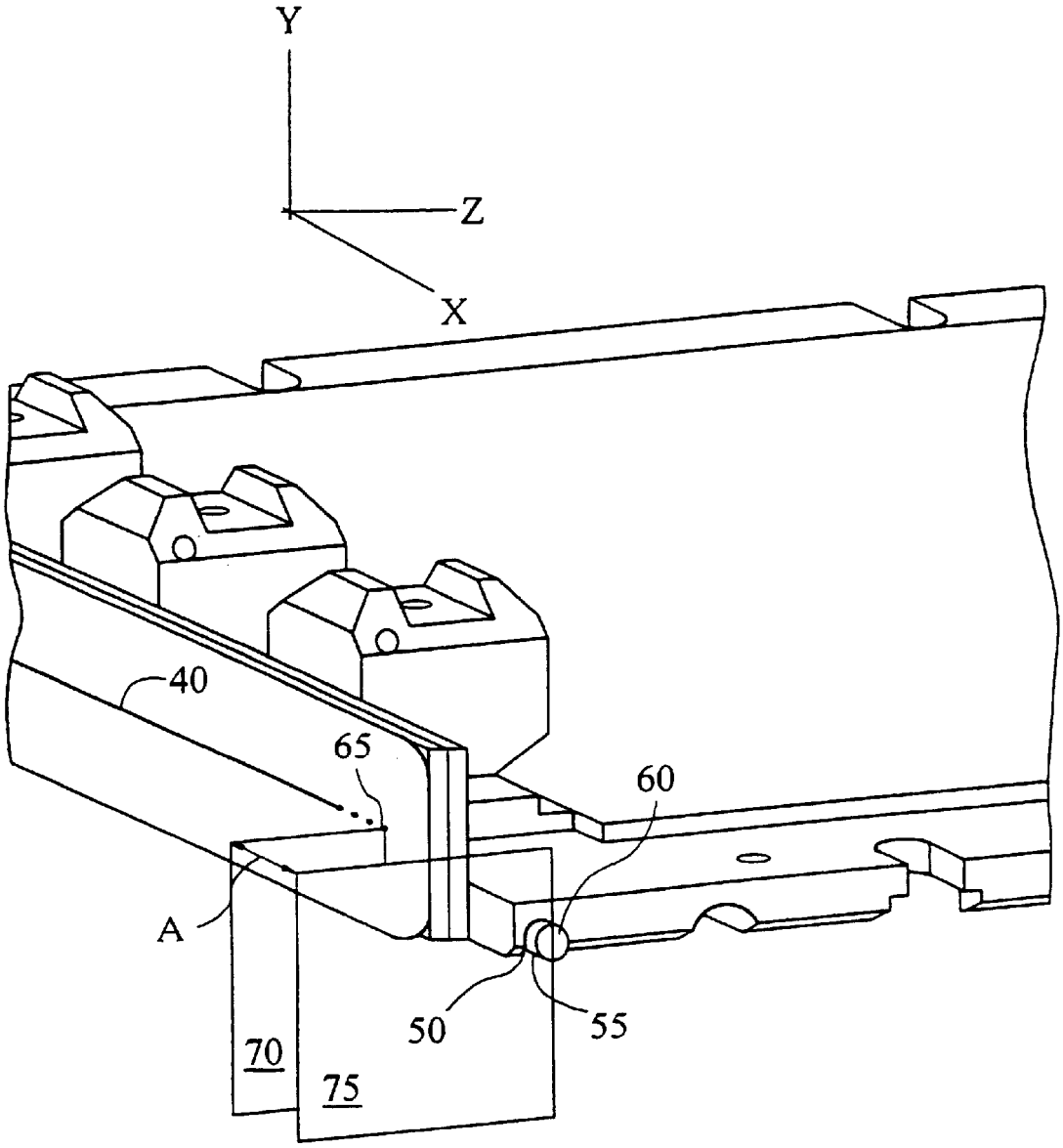
FIG. 2 is an enlarged view of the front end of the printhead of FIG. 1.

This is achieved according to the method illustrated schematically in FIG. 2: the printhead 5 together with the rod 55 located—but not secured—in groove 50 is placed in a jig (not shown) and the first nozzle 65 in the row of nozzles 40 aligned with a first jig reference plane 70. Next, the rod 55 is moved along the groove so as to align end face 60 with a second jig reference plane 75, spaced from the first jig reference plane by a fixed distance A. The rod is subsequently immovably secured in the groove and the printhead removed from the jig. When the printhead is subsequently mounted in a printhead support structure using this datum, the user can be certain that the first nozzle 65—and hence the whole nozzle array 40—of the printhead will be positioned a fixed distance relative to the support structure.

It will be appreciated that in practice, the first jig reference plane 70 will generally be defined by the cross-hairs of a microscope whilst the second jig reference plane will be defined by an abutment for the end of the rod 55. Although alignment with the nozzle 65 at the end of the nozzle row 40 is shown in the example of FIG. 2, alignment may be sought with nozzles located elsewhere in the row 40. Furthermore, some other feature having a position related to that of the nozzle—e.g. the ink channel located behind the nozzle and visible from the front of the printhead through the translucent material of the nozzle plate—may be used in the alignment process in place of the nozzle.

Befitting its reference function, rod 55 is preferably of a material having a low coefficient of expansion, for example quartz or a ceramic such as alumina. In the example shown, the rod is of 2 mm diameter and protrudes approximately 1 mm from the side of the body 15. Groove 50 is ideally located as near as possible to the plane of the nozzle plate so as to minimize errors due to expansion of the printhead base 15.

Figure 3:
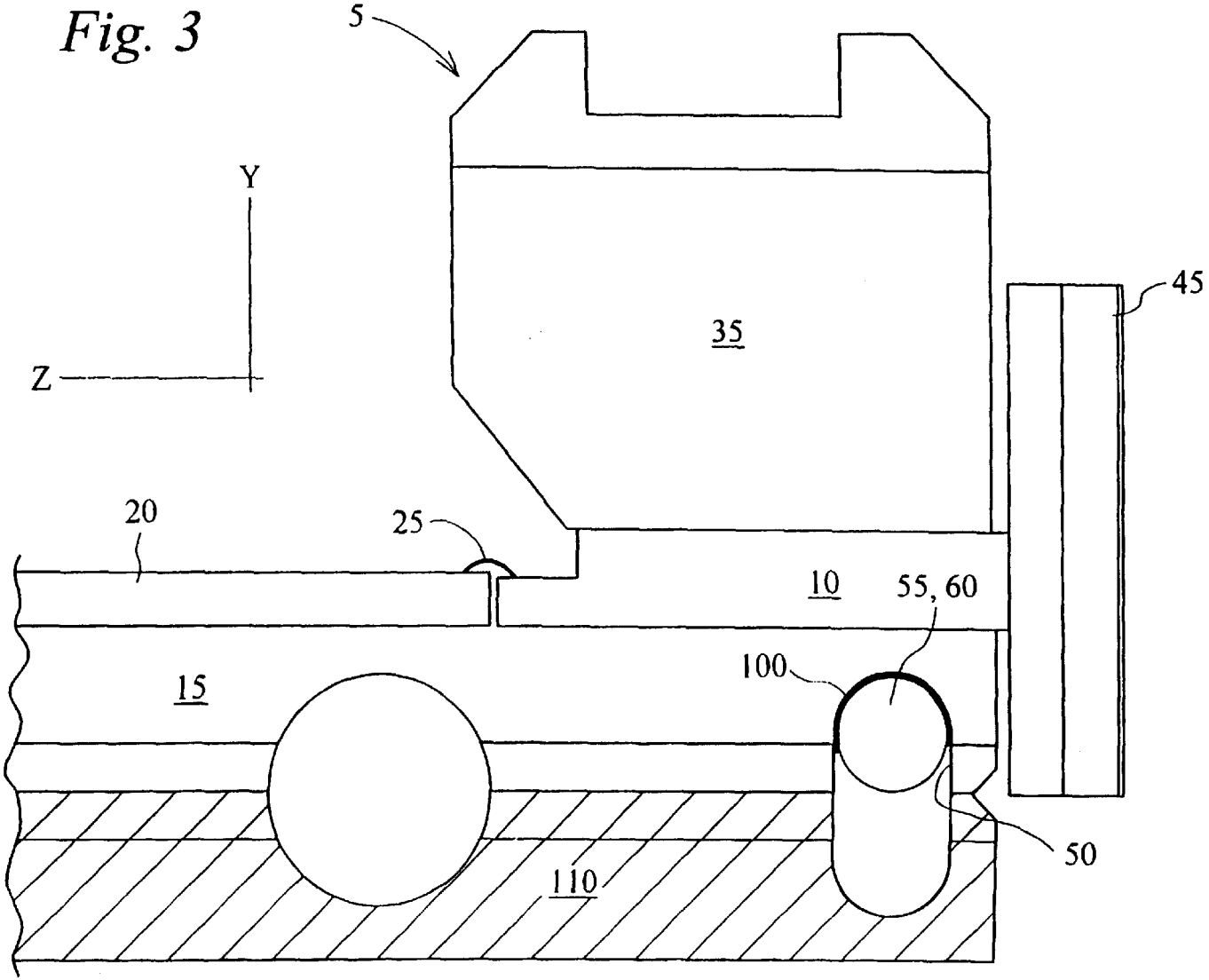
FIG. 3 is a sectional view through the front end of the printhead of FIG. 1 taken in the Y-Z plane.

FIG. 3 is an enlarged section through the front end of the printhead of FIG. 1 taken normal to the nozzle array direction X. At 100 is indicated the adhesive used to bond rod 55 into groove 50. Advantageously, this adhesive is chosen to be radiation (e.g. UV) curable and the material of the rod itself is chosen to be radiation transmitting (e.g. quartz) such that when in the jig and with the rod and printhead correctly positioned, one end of the rod can be exposed to UV light which is then transmitted along the rod and to the adhesive, which promptly cures, fixing the rod in position. The adhesive can, of course, fill the entire depth of groove 50.

As an alternative, a thermally-deformable material such as a thermoplastic material or a so-called "Woods Metal" can be used: the latter are low melting point (typically 60° C.) metals that can be kept liquid by means of a modest heat source until the rod is correctly positioned. Removal of the heat source then allows the metal to solidify, fixing the rod in place. The cooling of a thermoplastic material would have a similar fixing effect. However, methods—including conventional room-temperature curing adhesives—that avoid possible errors due to thermal expansion of the printhead (particular the aluminium base 15) are to be preferred.

The base of a second printhead, mounted in a so-called "back-to-back" relationship to the first printhead 5, is shown hatched at 110. Preferably, this second printhead also has its own datum rod, allowing the nozzles of both printheads to be accurately positioned relative to one another. In particular, the location of the datum rod in the second printhead can be chosen such that when assembled together, the nozzles of the second printhead are interleaved with those of the first printhead so as to give double printing resolution.

It will be appreciated that the above arrangement is given only by way of example and is not intended to restrict the scope of the present invention. The movable datum element/reference member need not have rod shaped form, nor does it have to sit beneath or within the printhead base. However, in order to reduce errors due to expansion of the base, the reference member is preferably secured to the base 15 over the same length as is the ink ejecting unit 10, ideally to that region of the base lying closest to the nozzle array 40. However, design considerations may dictate a smaller rod, perhaps restricted to a location adjacent the edge of the printhead. Further, it should be noted that whilst the reference/datum surface of the examples lies outside the spatial envelope of the printing unit and support member of the printhead, this need not be the case and that arrangements whereby the reference surface is located e.g. within the support member can be envisaged.

Various methods of securing the datum element, including conventional room-temperature curing adhesives and UV-initiated adhesives, may be employed. The technique can of course also be used to locate the printhead in other directions, particularly to ensure a constant nozzle plate to substrate distance (direction Z in FIG. 1) and may be used at more than one location on a printhead.

Figure 4:
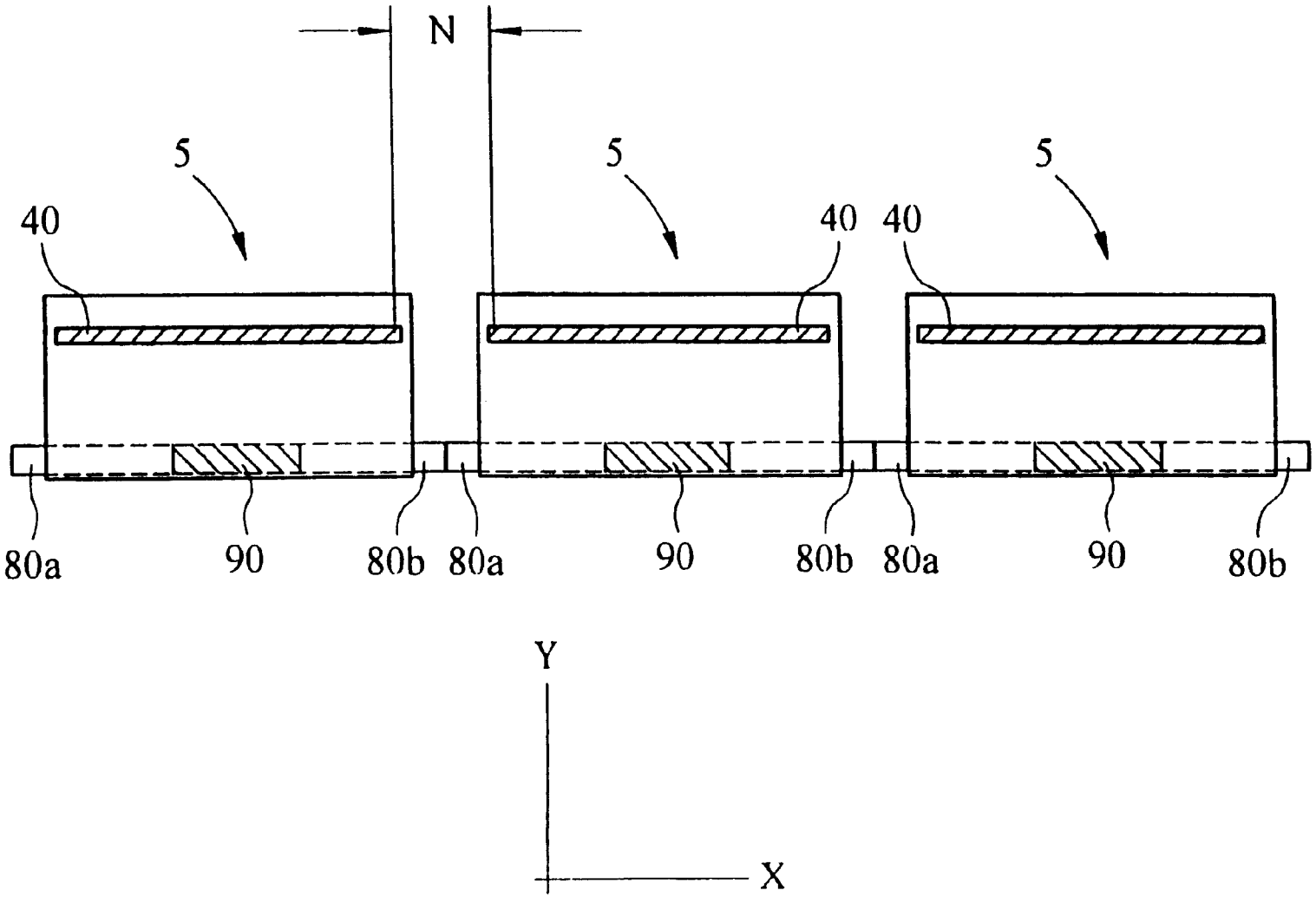
FIG. 4 is a schematic view showing an alternative arrangement of printheads manufactured according to the present invention.

FIG. 4 is a schematic front view (in the X direction) of several printheads 5 arranged in a butted, side-by-side relationship. Each printhead has an array of nozzles 40 and reference rods 80*a*, 80*b* on the left and right-hand side of each printhead respectively. Rod 80*a* is aligned in accordance with the present invention so as to be a predetermined distance from the furthest-left nozzle in array 40 whilst rod 80*b* is similarly aligned to be a predetermined distance from the furthest-right nozzle in array 40. It will be appreciated that such an arrangement allows the separation N of the adjacent nozzles of neighbouring printheads to be accurately controlled. Rods 80*a*, 80*b* are preferably joined together directly by a rigid bond 90 (e.g. epoxy adhesive) rather than via the printhead base so as to avoid errors due to the greater thermal expansion of the base material.

Figure 5:
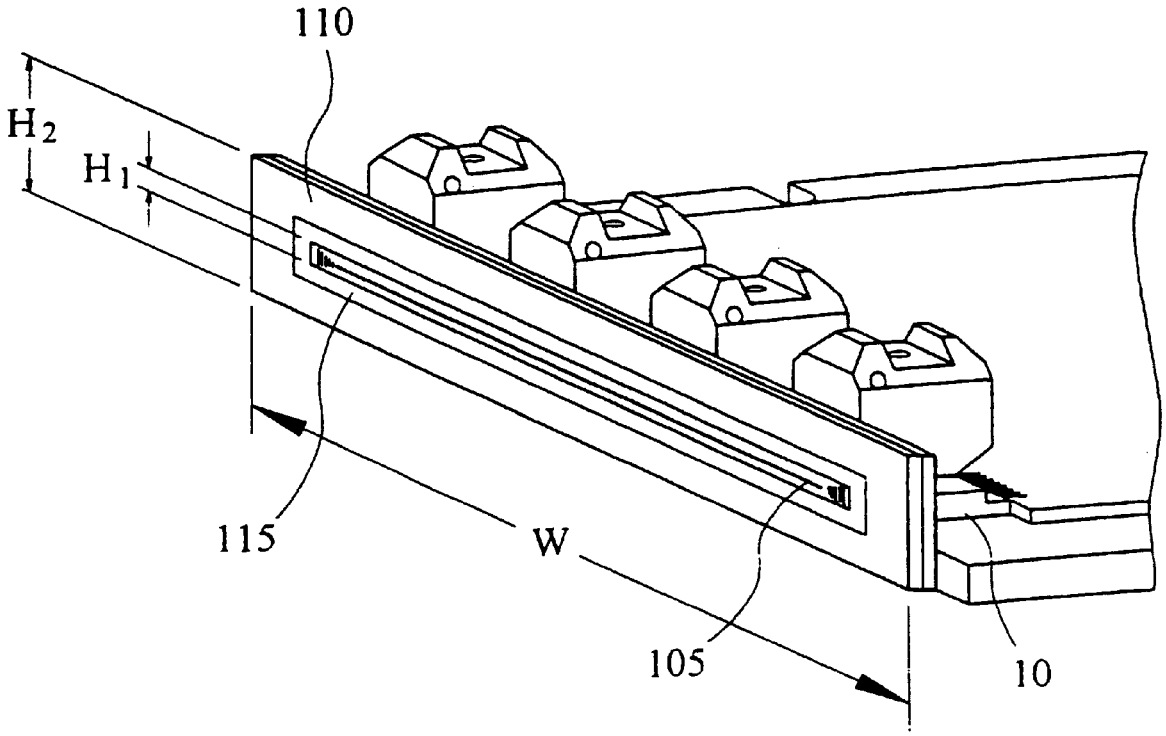
FIG. 5 is an enlarged view of the front end of the printhead of FIG. 1 with the nozzle plate removed.
Figure 6:
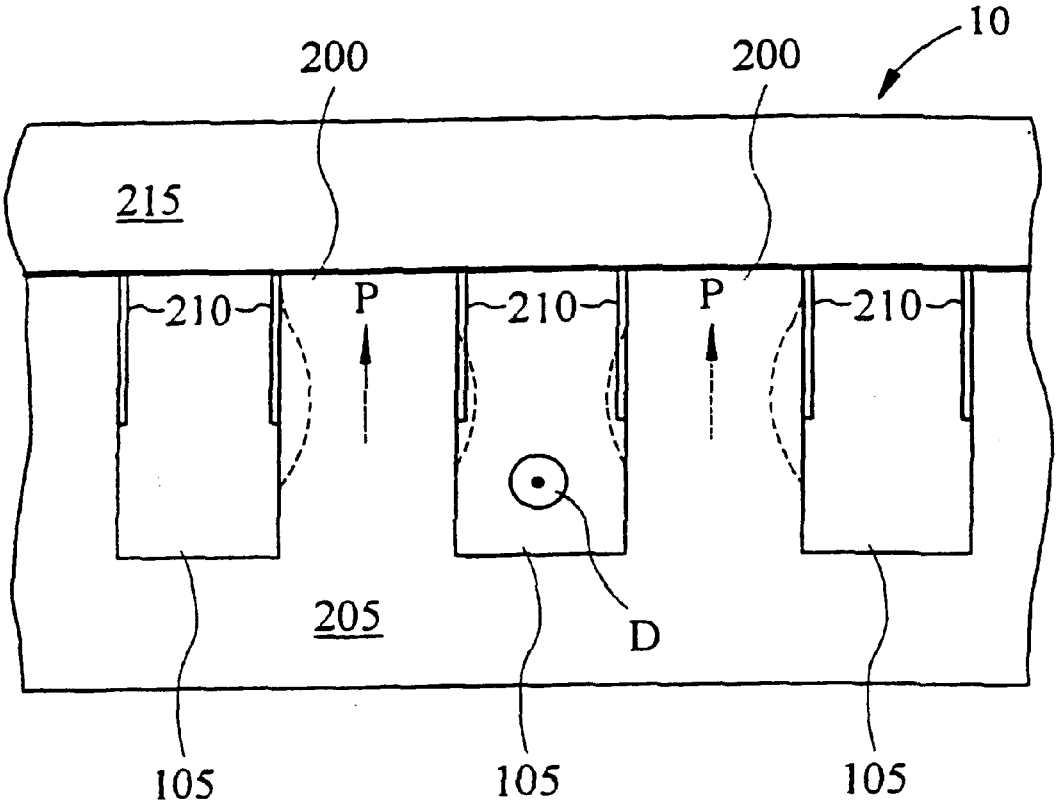
FIG. 6 is a cross-sectional view through channels of the ink ejecting units of FIG. 1.

Although the present invention is not limited to any particular kind of printing—particularly inkjet—apparatus, the arrangement described by way of example above and shown in FIG. 5 with the nozzle plate removed incorporates an ink ejecting unit that utilizes shear mode wall actuators. FIG. 6 shows sectional detail of these ink ejecting units 10 and the line of ink-ejecting chambers 105. These are of the kind disclosed in the aforementioned WO97/04963 or in EP-A-0 364 136 (also belonging to the applicant and incorporated herein by reference) and comprise ink-ejecting channels 105 having a longitudinal axis D and defined by actuator side walls 200 of poled piezoelectric material such as lead zirconium titanate (PZT). By means of electrodes 210 arranged in or on the walls, an electric field is applied to the piezoelectric material and normal to the direction P of polarization thereof so as to cause the walls to deflect by shear mode into the ink channel (as indicated by broken lines in FIG. 6) thereby to eject a droplet from a respective nozzle. For ease of manufacture, the entire ink ejecting unit comprising channel walls 200, base 205 and cover 215 may be made of piezoelectric material (the material of the cover need not be poled). Furthermore, several channel groups for ejecting several different colours of ink may be formed in a single base 205—registration between channels of different channel groups is thereby guaranteed.

The nozzle plate is arranged at one end of the channels 105 (in the plane of the paper in FIG. 3*a*) and is in sealing contact with the end of the ink ejecting unit, namely channel walls 200, base 205 and cover 210.

FIG. 7 shows an example of a nozzle plate/printhead body adhesive bond 220 prior to nozzle formation, the axis of the ink channel 105 being indicated by arrow D. The rear of the nozzle plate is scalloped as described in WO95/11131 (belonging to the present applicant and incorporated herein by reference) and has grooves 225 formed above and below the channels to accommodate excess glue that might otherwise seep into and obstruct the channels themselves. Further grooves 230 may also be formed at the junction of the nozzle plate with the top and bottom surfaces of cover 215 and base 205 respectively. Excess adhesive collecting in these channels forms fillets 235 which further strengthen the nozzle plate/ink ejecting unit bond.

FIG. 8 is a sectional view showing the nozzle plate support 110 which surrounds the ink ejecting unit 10 and comprises first and second members 300,305. The reference member (rod 55) of the present invention has been omitted for clarity.

First member 300 has a front face 320 to which the nozzle plate 45 is bonded (for example using the adhesive bonding techniques outlined in the aforementioned WO95/11131). It has been found that excess adhesive may collect as a meniscus along the line of intersection between the inner surface of the aperture 115 with the nozzle plate 45. To avoid interference between this meniscus and the front of the ink ejecting unit 10, aperture 115 may be made wider as indicated by dashed lines 340, with the aperture 350 in the second member 305 remaining a tight clearance fit on the ink ejecting unit 10 so as to aid location of the printhead within the second member.

The nozzle plate 45 also extends both above and below the ink ejecting unit 10 so as to provide a large peripheral region (reference number 50 in FIG. 1) against which the cap of a conventional printhead maintenance device can seal. To this end, the front face 320 of the first member is made flat to within 10 $\mu$m, this value having been found by the present inventors as being necessary to ensure good sealing with a cap. Materials suitable for the first member include ceramics, which are easily machined—for example by lapping—to the required flatness.

Preferably, the material of the first member has a thermal expansion coefficient ($T_{EC}$) that is substantially matched to that of the material of the printhead body: were this not the case, differences in the amount of thermal expansion between the ink ejecting unit 10 and first member 300 would lead to stresses in that (unsupported) part 325 of the nozzle plate 45 lying between the two members. Where, as in the present example, the printhead body is made of PZT ($T_{CE}$= $3\times10^{-6}$), suitable materials may include alumina, PZT itself and borosilicate glasses having $T_{CE}$ values lying within 3% of that of PZT.

Although such materials are by themselves brittle and easily broken, the assembly of first member 300 attached—for example by means of an adhesive layer 330—to a second support member 305 of a tougher material has proved robust. Again, this tougher material preferably has a $T_{CE}$ substantially matched to that of the first member. Aluminium, in particular, meets this criterion and furthermore is easily manufactured to the required dimensions (as shown in FIG. 2, the height H1 of the ink ejecting unit 10 is typically 2 mm, the height and width H2,W of the nozzle plate support typically 10 mm and 100 mm respectively.

Expressed in broad terms, the droplet ejection apparatus described above comprises at least one chamber formed in a body and communicating with droplet liquid supply means and with a respective nozzle formed in a separate nozzle plate; electrically actuable means for imparting pressure pulses to droplet liquid in the chamber to effect ejection of droplets from the nozzle; wherein the outlet of each respective nozzle is formed in a first surface of the nozzle plate having a first area, the nozzle plate and body being in sealing contact with one another over a second area smaller than the first area; and wherein the apparatus further comprises support means for supporting the periphery of the nozzle plate and comprising a first member having a surface that is flat to within 10 $\mu$m and to which the nozzle plate is attached, and a second member for supporting said first member.

Such a construction allows the nozzle plate to be supported by a material (preferably a ceramic such as alumina) that can easily be machined to the flatness required, whilst ensuring the robustness of the construction by supporting this material by a second member made of a tougher material such as aluminium. Robustness is required to withstand the forces to which a printhead might be exposed during its lifetime, in particular those generated during engagement/disengagement of a sealing cap from the nozzle plate.

One preferred method of assembly is as follows: nozzle plate support 110 is assembled from the first and second members 300, 305; nozzle plate 45 is attached to the nozzle plate support; adhesive is applied to the end face of ink ejection unit 10; nozzle plate support 110 is slid over the end of ink ejection unit 10 and the nozzle plate 45 is bonded to the end face of the ink ejection unit 10; support 110 is attached at its rear face 315 to the base 15 and, optionally, to the manifold 35 by compliant bonds 310. Preferably, the compliant bonds hold the nozzle plate pressed against front of the nozzle plate, causing the nozzle plate to bow out slightly.

FIG. 9 illustrates an alternative embodiment of the nozzle plate support of FIG. 8 in which aperture 350 is increased in height. This allows a temperature sensor 360 to be mounted at the front of the printhead and allows the chassis 15 to extend nearly to the front of the printhead, thereby facilitating the conduction of heat away from this area. FIG. 9 also shows a circuit board comprised of primary and secondary boards 20A, 20B electrically connected to one another and to the printhead 10 by means e.g. of wire bonds 370. Secondary circuit board 20B may be formed with conductive tracks spaced at an especially narrow pitch suited to connection to an integrated circuit 380 and/or the electrodes 210 of individual printhead channels 105 but inappropriate for the remaining, larger-scale components of the drive circuit. These can be mounted on primary circuit board 20A which, because it is formed with conductive tracks at a larger pitch, is less expensive to manufacture. Such a two-part arrangement helps minimize the cost of the printhead as a whole.

In a further embodiment, the nozzle plate 45 may be bonded to the front face 320 of the first member 300 prior to attaching the nozzle plate to the ink ejecting unit 10. This first step is carried out at a temperature that is significantly (approximately 40° C.) higher than the temperature which the nozzle plate will reach during printhead operation (typically 50° C.) such that, once the nozzle plate has bonded to the first member (generally a heat curing epoxy such as Epotek or Hi-Sol is used) and the assembly has been allowed to cool, the nozzle plate is held taut over the aperture (115, FIG. 2) in the first member.

This effect does, of course, rely on the $T_{CE}$ of the nozzle plate material being greater than that of nozzle plate support such that the nozzle plate will shrink more on cooling than will the surrounding support and thereby be stretched like a drum skin over the support. $T_{CE}$ values for the nozzle plate materials of polyimide, polycarbonate, polyester, polyetheretherketone and the like mentioned above lie in the range $20–50\times10^{-6}$/° C.

The stretched, tensioned nozzle plate 45 can subsequently be placed in sealing contact with the ink-ejecting channels 105 and the surrounding printhead body, preferably using an adhesive that cures at the nozzle plate operating temperature and/or has low shrinkage on curing and/or is elastic so as to avoid further distortion of the nozzle plate. Note that this step can generally be carried out at ambient working temperature—no problems have been encountered due to differentials between this and the nozzle plate operating temperature.

Expressed in broad terms, the droplet ejection apparatus described in the further embodiment above comprises an array of chambers formed in a body and having a respective array of outlets communicating with a respective array of nozzles formed in a separate nozzle plate; each chamber further communicating with droplet liquid supply means; the apparatus further comprising electrically actuable means for imparting pulses to droplet liquid in the chambers to effect ejection of droplets from respective nozzles; wherein that portion of the nozzle plate in which said array of nozzles is formed remains in substantially uniform tension in the nozzle array direction when the apparatus is at its operating temperature. Such a construction results in a nozzle plate that is held taut (like a drum skin) over the array of chamber outlets and which is consequently uniformly flat over the length of the array. This in turn increases the likelihood of the nozzles formed in the nozzle plate being of a uniform quality.

It will be appreciated that some allowance for thermal expansion will have to be made in the choice of material for the first and second members 300,305 and/or in the nature of the bond 330 between them.

Indeed, where the flatness of the periphery of the nozzle plate is not an issue—for example in a printhead where no capping is required—it may be desirable to make the nozzle plate support of a single material as shown in FIG. 10. As a material having a $T_{CE}$ that is less than that of the material of the nozzle plate 45 and yet matched to the PZT of the ink ejecting unit 10, INVAR (an iron/nickel alloy) has proved suitable. Alternatively, if the strength of the support is not critical, alumina may also be used, either as a single element or as the first and second members of a sandwich nozzle plate support construction as shown in FIGS. 8 and 9.

Releasable (e.g. hot melt) adhesives may be used to attached such a support to the ink ejection unit so as to allow the support/nozzle plate assembly to be replaced should the step of nozzle manufacture prove unsuccessful.

Whilst the present invention has been described with reference to piezoelectric inkjet printheads, it should be understood that this is by way of example only. The invention is equally applicable to other kinds of inkjet printhead—including thermal—and other kinds of printer having printing elements—including thermal transfer and wire dot printing elements.

The text of the abstract filed herewith is repeated here as part of the specification:

To allow accurate positioning relative to a printer mechanism, a printhead 5 is provided with a reference surface 60 formed on a reference member 55. Member 55 is attached to the base 15 of the printhead but positioned with reference to a nozzle 40 of an ink ejecting unit 10 mounted on the base member. This obviates the need for the base member to be manufactured to narrow tolerances.

What is claimed is:

1. Method of locating a reference surface on a printing apparatus, the apparatus comprising a printing unit having at least one printing element and mounted on a support member;

the method comprising the steps of:

positioning the apparatus such that said printing element is located at a first predetermined position;

positioning a reference member having said reference surface such that said reference surface is located at a second predetermined position;

said first and second positions being in a predetermined spatial relationship;

and fixing the reference member to said support member, thereby to fix said reference surface in said second predetermined position relative to said printing element.

2. Method according to claim 1 and wherein said printing element is a droplet ejecting element.

3. Method according to claim 2 and wherein said droplet ejecting element is a nozzle.

4. Method of manufacturing a printing apparatus, the apparatus including a printing unit comprising a droplet ejection unit having at least one printing element, said at least one printing element comprising at least one nozzle for droplet ejection formed in a nozzle plate, and a support member for said droplet ejecting unit;

the method comprising the steps of:

mounting said droplet ejecting unit on said support member; thereafter forming said at least one nozzle in said nozzle plate of the droplet ejecting unit;

and thereafter arranging a reference member such that a reference surface of said reference member is located at a predetermined position relative to said at least one nozzle; and fixing the reference member to said support member.

5. Method according to claim 4 and further comprising the steps of:

positioning the apparatus such that said printing element is located in a first additional predetermined position;

positioning said reference member such that said reference surface is located at a second additional predetermined position;

thereby to locate said reference surface at said predetermined position relative to said at least one nozzle.

6. Method according to claim 4 and further comprising the step of directing a high energy beam from a source of said high energy beam at that surface of the nozzle plate from which droplet ejection takes place, thereby to form said at least one nozzle.

7. Method according to claim 4 and further comprising the steps of:

attaching said printing apparatus to a mechanism for effecting relative movement between the apparatus and a substrate to be printed;

abutting said reference surface against a corresponding reference surface cf said mechanism, thereby to align said at least one printing element with said substrate.

8. Method according to claim 4, wherein said support member is adapted for attachment to a mechanism for effecting relative movement between the printing apparatus and a substrate to be printed.

9. Method according to claim 4, wherein said support member carries electronic drive circuitry for said printing unit.

10. Method according to claim 4, wherein said support member carries means for supplying droplet fluid to the droplet ejecting unit.

11. Method according to claim 4, wherein said printing unit has a plurality of said printing elements arranged co-linearly in an array direction and wherein said reference surface lies in a plane, the method further comprising the step of fixing the reference member to said support member such that said plane lies normal to the array direction.

12. Method according to claim 11 and wherein said reference member has a longitudinal axis and is of uniform cross section perpendicular to said axis, the method further comprising the step of fixing said reference member such that said axis lies parallel to said line of co-linearly arranged printing elements.

13. Method according to claim 11 and wherein said printing unit has a plurality of said printing elements arranged co-linearly along a line having two ends, the method further comprising the step of:

positioning the apparatus such that a printing element at one of the ends of said line of printing elements is located at a predetermined position relative to said reference surface.

14. Method according to claim 13 wherein the end of said line of printing element nearest said reference surface is located at a predetermined position relative to that surface.

15. Method according to claim 13 and further comprising the steps of:

fixing said reference surface in said predetermined position relative to a printing element at one end of said line of printing elements; and fixing an additional reference surface of an additional reference member in an additional predetermined position relative to a printing element at the other end of said line of printing elements.

16. Method according to claim 15 and wherein said reference members are arranged co-linearly.

17. Method according to claim 16 and further comprising the step of forming a rigid bond between said reference members.

18. Method according to claim 4 wherein said plurality of printing elements are arranged co-linearly in a line and further comprising the step of fixing the reference member to that region of said support member lying closest to said line of co-linearly arranged printing elements.

19. Method according to claim 18 wherein said support member extends substantially in a plane, the method further comprising the step of fixing said reference member so as to lie substantially in said plane.

20. Method according to claim 4 and further comprising the step of fixing the reference member to said support member by means of adhesive.

21. Method according to claim 20 and wherein said adhesive is radiation-curing adhesive.

22. Method according to claim 21 and further comprising the step of transmitting radiation to said adhesive via said reference member, thereby to cure said adhesive.

23. Method according to claim 22 and wherein said reference member has a longitudinal axis and is of uniform cross section perpendicular to said axis, the method further comprising the step of applying a source of radiation to a surface of the reference member lying perpendicular to said axis.

24. Method according to claim 4 and further comprising the step of positioning said reference member relative to said support member with thermally-deformable material such as a thermoplastic material or a Wood's metal therebetween, and cooling said thermally-deformable material, thereby to fix said reference member to said support member.

* * * * *